US005176253A

United States Patent [19]

Perrin et al.

[11] Patent Number: 5,176,253

[45] Date of Patent: Jan. 5, 1993

[54] GOLF BAG WITH POCKET ASSEMBLY

[75] Inventors: Jack B. Perrin, Malibu; Stephen J. Perrin, Camarillo, both of Calif.

[73] Assignee: Illah California, Inc., Oxnard, Calif.

[21] Appl. No.: 816,806

[22] Filed: Jan. 3, 1992

[51] Int. Cl.[5] ..... A63B 55/00; A63B 55/02

[52] U.S. Cl. ..... 206/315.5; 206/315.3; 224/224; 224/918; 224/919

[58] Field of Search ..... 206/315.3-315.7; 190/108; 224/224, 918, 919

[56] References Cited

U.S. PATENT DOCUMENTS

| | | | |
|---|---|---|---|
| 1,676,592 | 7/1928 | White | 206/315.6 |
| 1,845,088 | 2/1932 | Hunerhoff | 206/315.5 |
| 2,436,688 | 2/1948 | Corbett | 206/315.3 |
| 2,711,201 | 6/1955 | Hotze | 206/315.5 |
| 3,548,905 | 12/1970 | Renshaw | 206/315.3 |
| 4,263,950 | 4/1981 | Brown | 206/315.6 |
| 4,436,189 | 3/1984 | Baum | 190/108 |
| 4,768,650 | 9/1988 | Chancellor, Jr. | 206/315.5 X |
| 4,804,121 | 2/1989 | Stanton et al. | 206/315.5 X |
| 4,881,638 | 11/1989 | Cho | 206/315.5 X |
| 5,031,812 | 7/1991 | Gustine | 206/315.5 X |
| 5,072,867 | 12/1991 | Zingale | 206/315.3 X |

FOREIGN PATENT DOCUMENTS

| | | | |
|---|---|---|---|
| 414178 | 8/1934 | United Kingdom | 206/315.3 |
| 468429 | 7/1937 | United Kingdom | 206/315.3 |

*Primary Examiner*—Sue A. Weaver

*Attorney, Agent, or Firm*—Poms, Smith, Lande & Rose

[57] ABSTRACT

A golf bag for carrying golf clubs and related accessories. The bag has a carrying strap which can be folded and stored in a compartment in the bag when not in use. The bag also has a carrying pouch which can be detached from the bag and worn about the waist of a user. The bag also has a zippered pocket which, when opened, renders the contents immediately accessible to the user.

21 Claims, 3 Drawing Sheets

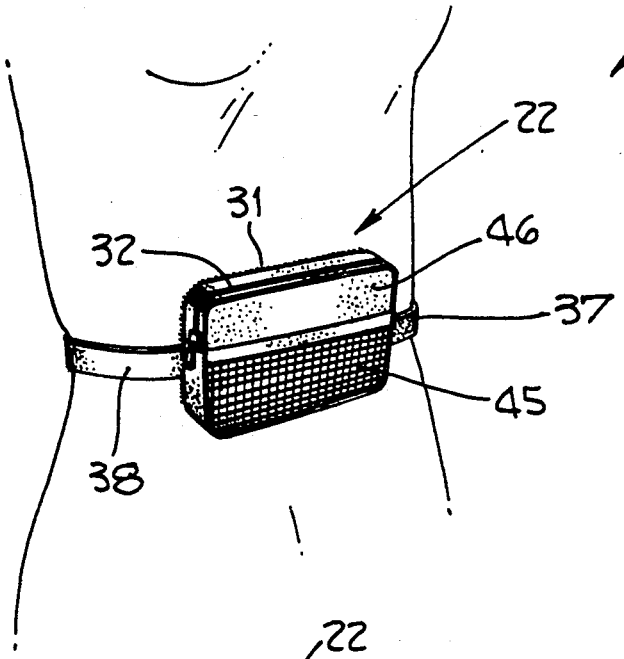
Fig. 3.
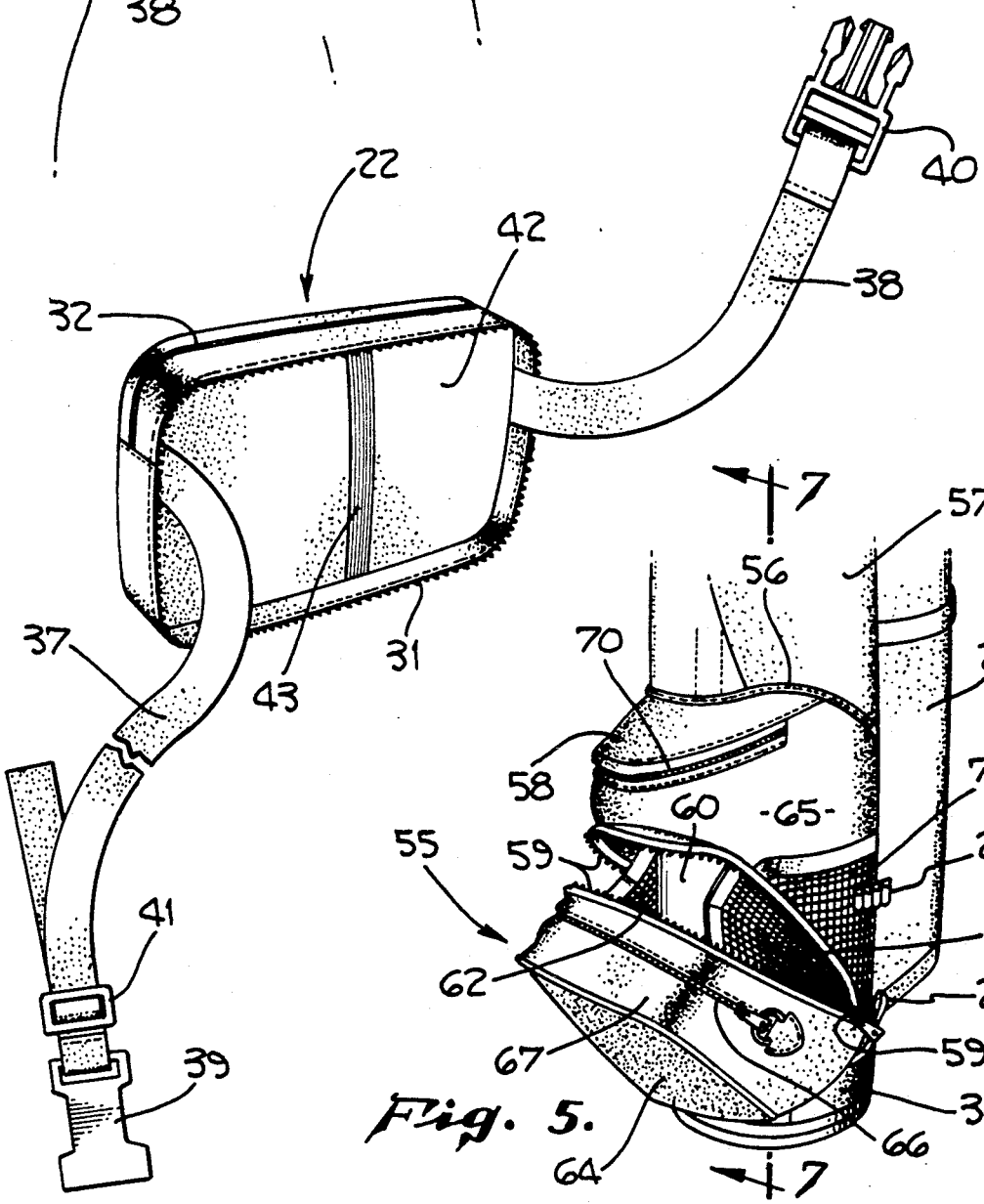
Fig. 4.
Fig. 5.

GOLF BAG WITH POCKET ASSEMBLY

BACKGROUND OF THE INVENTION

1. Field of the Invention

The invention relates to golf bags; and, more particularly, to a golf bag having storage for the carrying strap, a detachable pouch and an easy access zippered pocket.

2. Discription of the Prior Art

Golf bags are well known in the art. Such bags generally have a main cylindrical support tube open at the top for insertion of a plurality of golf clubs therein. A shoulder strap of some type is generally provided on the bag. One such arrangement is disclosed in U.S. Pat. No. 4,768,650 to Chancellor. Such bags usually have one or more compartments for carrying various golfing accessories, such as balls, tees, etc. There exists a need for a golf bag wherein the carrying strap can be stored when it is not needed to carry the bag. Also, about 60% of golf bags are used by men and the rest by women. It is usually necessary to make different bags for men and women since their needs differ. There is a need for. a unisex golf bag that can be adapted to men and women. Finally, there is a need in such golf bags to have an easily accessible pocket for quickly storing dirty golf balls or the like.

SUMMARY OF THE INVENTION

It is an object of this invention to provide an improved golf bag.

It is a further object of this invention to provide a golf bag having a shoulder strap for carrying the bag, the bag having a compartment for storing the strap when not needed.

It is still another object of this invention to provide a golf bag that can be used for men and women, the bag having a detachable pouch that can be left on the bag when used by a man, or detached therefrom and worn about the waist when used by a woman.

It is still further a object of this invention to provide a golf bag having a zippered pocket that, when opened, presents a shallow pocket for storing dirty golf balls or the like therein.

These and other objects are preferably accomplished by providing a golf bag for carrying golf clubs and related accessories having a carrying strap which can be folded and stored in a compartment in the bag when not in use. The bag also has a carrying pouch which can be detached from the bag and worn about the waist of a user. The bag also has a zippered pocket which, when opened, renders the contents immediately accessible to the user.

BRIEF DESCRIPTION OF THE DRAWING

FIG. 3 is a perspective view of the detachable pouch of the golf bag of FIGS. 1 and 2 shown worn about the waist of a user;

FIG. 4 is a perspective view of the pouch alone of FIG. 3;

FIG. 5 is a perspective view of a portion of the bag of FIGS. 1 and 2 showing the zippered pocket thereof in open position;

DESCRIPTION OF THE PREFERRED EMBODIMENT

Figure 1:
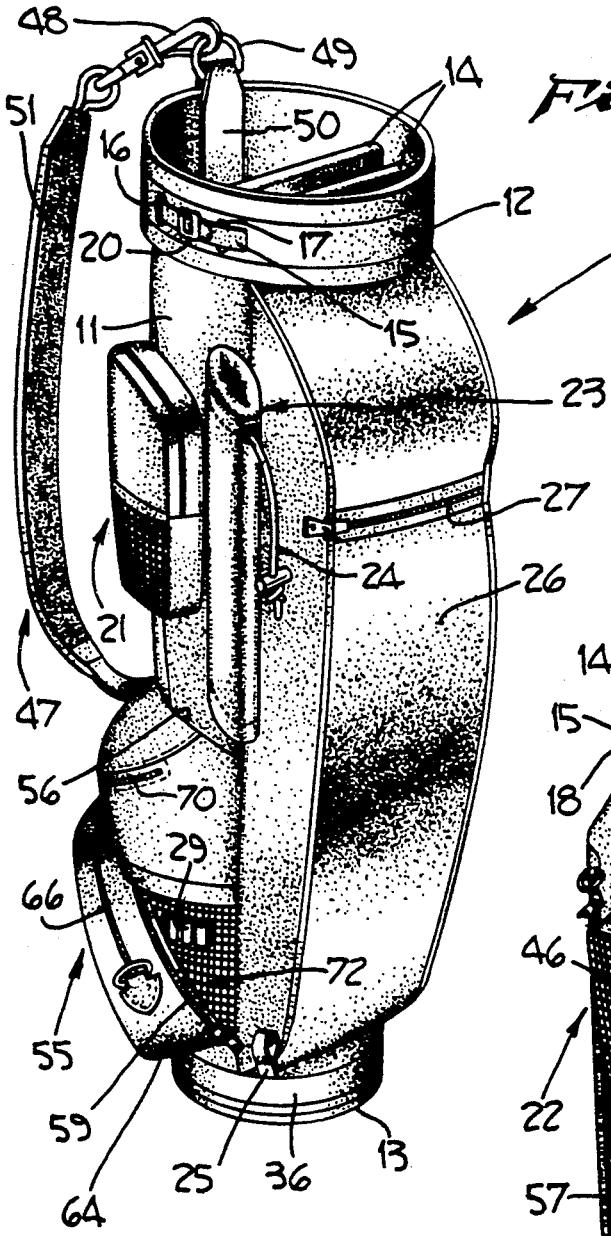
FIG. 1 is a front perspective view of a golf bag in accordance with the teachings of the invention.

Referring now to FIG. 1 of the drawing, a golf bag 10 is shown having a central generally cylindrical support tube 11 which may have a generally rigid ring 12 at top and a generally round rigid flat base 13 at bottom. The portion of tube 11 between ring 12 and base 13 may be fabricated from any suitable materials, such as steel, plastics, etc., or may be of a suitable natural or synthetic fabric material supported by suitable bracing means, such as spaced vertical steel straps. Ring 12 and base 13 may also be of any suitable materials, such as metal, plastic, etc.

Figure 2:
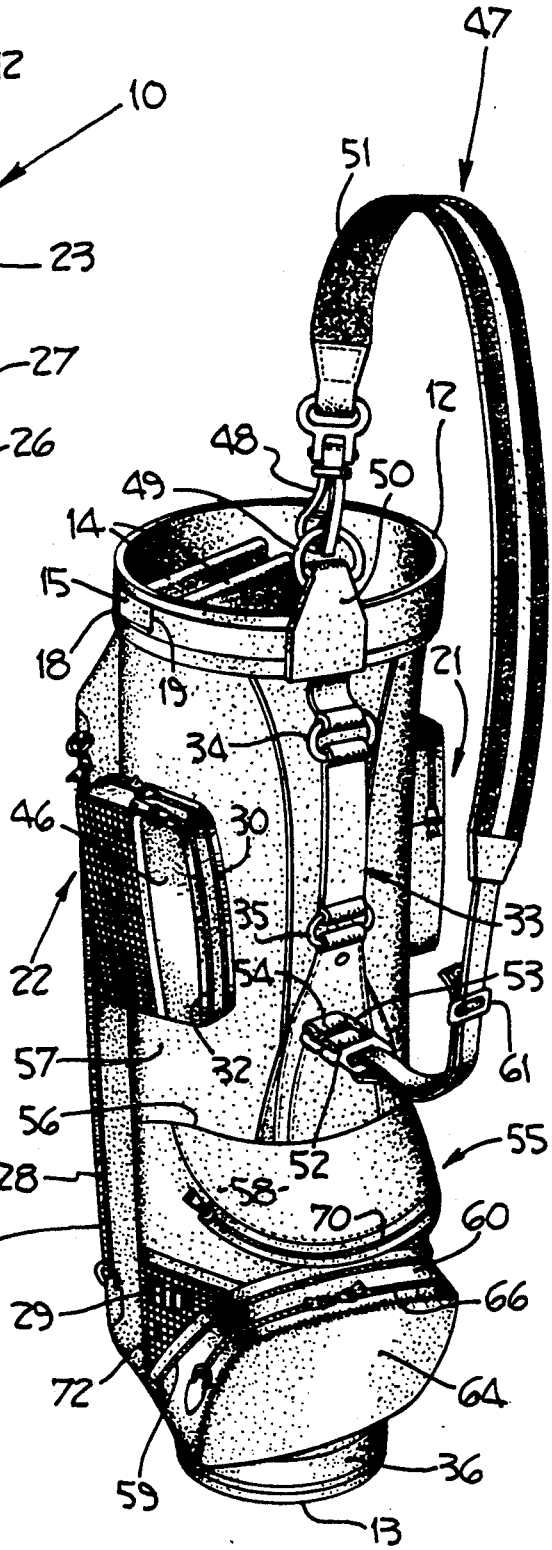
FIG. 2 is a rear perspective view of the golf bag of FIG. 1.

Tube 11 may be internally lined with a suitable fur material or the like and divided internally by a plurality of full length dividers 14 so as to separate the various golf clubs placed therein. A flexible strap 15 may be provided on the outside of ring 12 connected through openings 16, 17 in ring 12 to dividers 14 and exiting on the other side of ring 12, through openings 18, 19 (see FIG. 2). The free ends of strap 15 terminate in a buckle 20 (FIG. 1). Selective tightening and loosening of buckle 20 either pulls dividers 14 together or allows them to be pushed apart to vary the spacing therebetween.

A plurality of pockets for storage may be provided on golf bag 10 at different locations, as is well known in the golf bag art. For example, zippered small storage pockets or pouches 21, 22 (FIGS. 1 and 2) may be provided on opposite sides of golf bag 10. A cushioned hollow tube 23 (FIG. 1), open therethrough, and secured by a cord lock 24, is provided for storing an umbrella or putter therein, as is well known in the golf bag art. The strap 25 at bottom may be used to secure the bottom of the umbrella.

A full length garment storage pocket 26 (FIG. 1) may be provided extending along one side of golf bag 10 essentially from the top to bottom thereof. Storage pocket 26 may be zippered, at zipper 27, for provided access to the interior thereof and may be internally sectioned to provide an upper storage pocket for a scorecard or the like and a lower storage chamber (elongated zipper 28 along one vertical side of pocket 26—FIG. 2—providing access to the interior thereof for storing of garments, a separate travel or raingear, etc.).

A plurality of tubular members 29 may be provided on bag 10 at various locations for receiving golf tees therein. A harness comfort handle 33 (FIG. 2) for toting bag 10 may be provided secured to spaced rings 34, 35 attached to bag 10. A trunk assistance carrying handle 36 may be provided at the bottom of bag 10.

Other than the pouch 22, as will be discussed, the aforementioned features of golf bag 10 are generally old and well known in the golf bag art. However, as specifically contemplated in the present invention, pouch 22 may be mounted to bag 10 by a zipper 30 that extends about the entire periphery of pouch 22 and, thus, allows removal of pouch 22 from golf bag 10 as seen in FIG. 4 (zipper portion 31 forming a mating part of zipper 30, the other part remaining attached to bag 10). In this manner, pouch 22 can be used by a golfer, as in FIG. 2, by opening zipper 32 providing access to the interior thereof. However, pouch 22 can be quickly and easily removed from bag 10 by unzipping zipper 30. As seen in FIG. 4, a pair of mating strap portions 37, 38 are secured at one end to the rear wall 42 of pouch 22 and terminate at the other end in quick release mating buckle portions 39, 40, respectively. A strap adjustment member 41 may be provided on strap portion 37. A resilient retaining strip 43 may extend transversely across rear wall 42. Strap portions 37, 38 thus are normally folded and inserted under strip 43, the resiliency of strip 43 holding the strap portions 37, 38 against wall 42 and within the confines of zipper portion 31.

Figure 6:
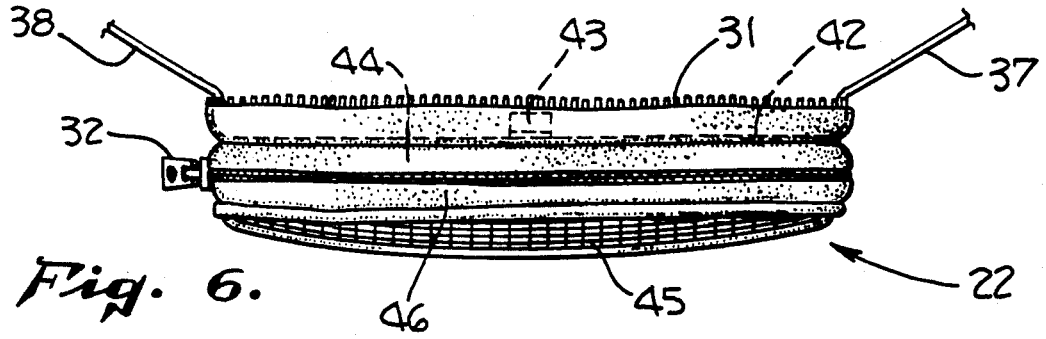
FIG. 6 is a top plan view of the pouch 22 alone of FIGS. 1 and 2.

As seen in FIG. 6, when opened, zipper 32 provides access to internal compartment 44. A mesh panel 45 (see also FIGS. 2 and 3) is provided on the outside of pouch 22 separated from the outer wall 46 to provide a pocket for golf balls or gloves or the like.

As seen in FIG. 3, pouch 22 can be worn about the waist of a player with buckle portions 39, 40 quickly and easily snapped together. Strap adjustment member 41 can be used to adjust the length of strap portion 37 as is well known in the art. Thus, a zip-off waist pouch is provided with an adjustable buckle belt.

A fully adjustable shoulder strap 47 (FIGS. 1 and 2) is provided for carrying golf bag 10. Strap 47 has a snap hook 48 at one end adapted to releasably snap on to a ring 49 mounted to a flap 50 on the top of bag 10. Strap 47 may be internally cushioned, as lined with fur and foam padding 51, and at the bottom terminates in a buckle 52. Buckle 52 may be comprised of mating snap fit buckle portions, such as portions 39, 40 in FIG. 4, and further description thereof is deemed unnecessary. One of these buckle portions is secured to ring 53 mounted to flap 54 on the bottom of bag 10. A strip adjustment member 61 may be provided on strap 47 for adjusting the overall length thereof.

Figure 7:
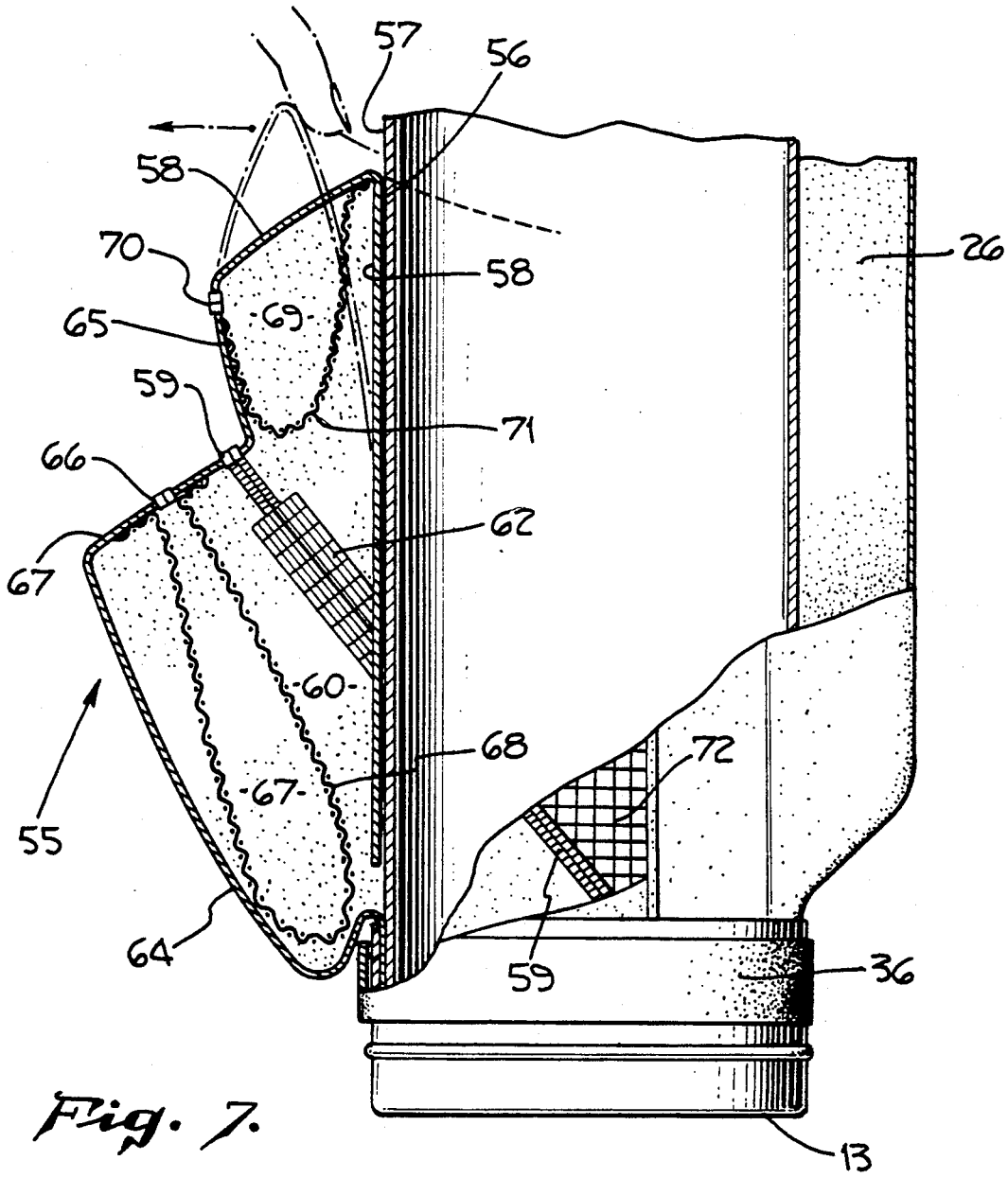
FIG. 7 is a view taken along lines 7—7 of FIG. 5.

As particularly contemplated in the invention, a multipocket assembly 55 (FIGS. 1, 2 and 5) is mounted at the bottom of bag 10. Pocket assembly 55 may be secured, as by stitching, to the outside wall 57 of bag 10 along the outer periphery except for the upper flange 56. Thus, as seen in FIG. 7, a hidden pocket or pouch 58 is provided between pocket assembly 55 and the wall 57 of golf bag 10. Access thereto is provided by pulling seam or flange 56 outwardly away from bag 10 (shown in phantom lines in FIG. 7). This seam or flange 56, along with assembly 55, has some inherent resiliency due to fabric material of assembly 55. This allows seam or flange 56 to be pulled outwardly a sufficient distance to allow insertion of strap 47 between the outer wall of bag 10 and pocket assembly 55, forming a storage compartment for strap 47. Strap 47 may be pushed down and stored therein (whether connected to rings 49, 53 or not) when not in use. The seem or flange 56 moves back against strap 47 when released.

Again referring to pocket assembly 55, as particularly contemplated in the present invention, a zipper 59 may extend from the bottom of one side of bag 10 to the bottom of the other side of bag 10 (compare FIGS. 1 and 5) which, when unzipped, opens assembly 55 to expose an inner large mouthed mesh lined pocket 60.

Pocket 60 may have a pair of meshed, side flaps 62, 63 (FIG. 5) securing the lower portion 64 of assembly 55 from the upper portion 65 thereby holding pocket 60 in the accessible hold-out position shown in FIG. 5. The lower portion 64 may also have an internal pocket 67, access thereto being provided by zipper 66. Pocket 60 may be separated from the lower pocket 67 by a meshed partition wall 68.

Upper portion 65 may also have an internal pocket 69 therein, access thereto being provided by zipper 70 (FIG. 7). Pocket 69 may be separated from the pocket 60 by a mesh partition wall or liner 71.

Thus, mesh lined pocket 69 may be used to store soiled gloves or the like. The wide-mouthed pocket 60 my be used for balls and other accessories, the entire contents being both visible and completely accessible. An additional storage pocket 67 is also provided. Finally, mesh sections 72, to which the tee holders 29 are attached, FIG. 2, may be provided on each side of assembly 55, open at the top, for insertion of cards or the like rewarding free shots, called mulligans, to the golfer.

It can be seen that there is disclosed a golf bag having a variety of novel features. The carrying shoulder strap can be quickly and easily stored when not in use. The pocket 60 zippers all the way around to display the entire contents, presenting a shallow pocket due to mesh liner partition wall 68, while held in an open accessible position by meshed side flaps 62, 63. Old dirty golf balls can be placed in pocket 60 while dirty or wet gloves can be placed in upper pocket 69, the mesh liner 71 allowing quick drying of the gloves. The waist pouch 22 can be either left on the bag 10, or removed and worn about one's waist to act as a wallet or purse.

There thus is disclosed a new improved golf bag having unique features not heretofore known. Obviously any suitable materials may be used and variations may occur to an artisan.

I claim:

1. A golf bag comprising:

a main central hollow support tube having an outer wall, an open top and a closed bottom for carrying golf clubs therein;

a shoulder strap having one end secured adjacent to the top of said bag and the other end secured above the bottom of said bag for carrying said bag;

a pocket assembly having an upper end, a lower end, and interconnecting sides mounted to the outer wall of said bag below said strap, said pocket assembly having at least one internal pocket therein and secured to said bag about the periphery of said lower end and said interconnecting sides whereby, when said pocket assembly is pulled away from said bag at said upper end, a space is provided between said pocket assembly and the outer wall of said bag for storing said strap therein.

2. In the golf bag of claim 1 wherein said strap is detachably mounted to said bag.

3. In the golf bag of claim 1 including a detachable pouch having means for mounting to said bag.

4. In the golf bag of claim 3 wherein said detachable pouch has a front wall and a rear wall,.the rear wall of said pouch being detachably secured to the outer wall of said golf by said mounting means.

5. In the golf bag of claim 4 wherein said means for mounting said pouch to said bag is a zipper having a first zipper portion extending about substantially the entire periphery of said pouch rear wall adapted to mate with a second zipper portion on the outer wall of said golf bag.

6. In the golf bag of claim 5 wherein said detachable pouch has at least one internal normally closed compartment.

7. In the golf bag of claim 4 including a pair of mating straps, one of which is connected to said pouch rear wall on one side thereof, the other of which is connected to said pouch rear wall on the other side thereof, said mating straps terminating in detachable buckles, said mating straps being normally disposed internally of said detachable pouch between said pouch rear wall and the outer wall of said golf bag when said detachable pouch is attached to the outer wall of said bag.

8. In the gold bag of claim 7 including a resilient strip with means securing said strip to said pouch such that said strip extends across the pouch rear wall, said mating straps being secured between said strip and said pouch rear wall when said detachable pouch is attached to the outer wall of said bag.

9. In the golf bag of claim 4 including a meshed panel attached to said pouch front wall by attaching means such that said panel is opening along at least one side thereof for providing access to a pocket formed between said meshed panel and said pouch front wall.

10. In the golf bag of claim 1 wherein said at least one internal pocket of said pocket assembly includes a closure member extending from a position adjacent one side of the lower end of said pocket assembly up along one side thereof, across substantially the middle thereof to the other side of said pocket assembly and down to a point adjacent the other side of the lower end of said pocket assembly.

11. In the golf bag of claim 10 wherein said closure member is a zipper.

12. In the golf bag of claim 10 wherein an internal meshed partition wall internally of said internal pocket separates said internal pocket from a second lower pocket in said pocket assembly.

13. In the golf bag of claim 12 including internal pocket hold-out means associated with said pocket assembly for holding said internal pocket in a hold-out position when said closure member is opened.

14. In the golf bag of claim 13 wherein said closure member includes a pair of mating closure portions, said hold-out means including meshed side panels interconnecting opposite sides of said internal pocket to opposite sides of one of said closure portions.

15. In the golf bag of claim 14 including at least one meshed panel and means for attaching said panel on the exterior of said pocket assembly open at the top providing a pocket between said meshed panel and the exterior of said pocket assembly.

16. A golf bag comprising:

a main central hollow support tube having an outer wall, an open top and a closed bottom for carrying golf clubs therein;

a shoulder strap having one end secured adjacent the top of said bag and the other end secured above the bottom of said bag for carrying said bag;

a pocket assembly having a front wall, an upper end, a lower end, and interconnecting sides and means for mounting said pocket assembly to the outer wall of said bag below said strap, said pocket assembly having at least one internal pocket (60) therein, said at least on internal pocket (60) of said pocket assembly being normally closed by a first closure member (59) extending from a position adjacent one side of the lower end of said pocket assembly up along one side thereof, across substantially the middle thereof to the other side of said pocket assembly and down to a point adjacent the other side of the lower end of said pocket assembly;

an internal meshed partition wall (68) internally of said first internal pocket (60) and lying in a plane substantially parallel to the plane of the front wall (64) of said pocket assembly, said partition wall (67) dividing the interior of said internal pocket (60) into a pair of pockets (60, 67) said partition wall (68) encompassing one of said pockets (67), said last mentioned pocket (67) being accessible through a second closure member (66) when said second closure member (66) is in an open position; and internal pocket hold-out means associated with said pocket assembly for holding said internal pocket in a hold-out position when said member is opened.

17. In the golf bag of claim 16 wherein said closure members are zippers.

18. In the golf bag of claim 16 wherein said first closure member includes a pair of mating closure portions, said hold-out means including meshed side panels interconnecting opposite sides of said internal pocket to opposite sides of one of said closure portions.

19. In the golf bag of claim 18 including at lest on meshed panel and means for attaching said panel on the exterior of said pocket assembly open at the top providing a pocket between said meshed panel an the exterior of said pocket assembly.

20. A golf bag comprising:

a main central hollow support tube having an outer wall, an open top and a closed bottom for carrying golf clubs therein;

a shoulder strap having one end secured adjacent to the top of said bag and the other end secured above the bottom of said bag for carrying said bag;

a pocket assembly having an upper end, a slower end an interconnecting sides mounted to the outer wall of said bag;

a detachable pouch mounted to said bag having a front wall and a rear wall, the rear wall of said pouch being detachably secured to the outer wall of said golf bag by a zipper having a first zipper portion extending about substantially the entire periphery of said pouch rear wall adapted to mate with a second zipper portion on the outer wall of said golf bag; and a pair of mating straps, one of which is connected to said pouch rear wall on one side thereof, the other of which is connected to said pouch rear wall on the other side thereof, said mating straps terminating in detachable buckles, said mating straps being normally disposed internally of said detachable pouch between said rear wall and the outer wall of said golf bag when said detachable pouch is attached to the outer wall of said bag.

21. In the golf bag of claim 20 wherein said detachable pouch has at least one internal normally closed compartment.

* * * * *

UNITED STATES PATENT AND TRADEMARK OFFICE

CERTIFICATE OF CORRECTION

PATENT NO. : 5,176,253

DATED : January 5, 1993

INVENTOR(S) : Jack B. Perrin and Stephen J. Perrin

It is certified that error appears in the above-identified patent and that said Letters Patent is hereby corrected as shown below:

Col. 5, line 7, "gold" should be --golf--.

Col. 5, line 58, "on" should be --one--.

Col. 6, line 26, "list on" should be --least one--.

Col. 6, line 38, "slower" should be --lower--.

Signed and Sealed this

Second Day of November, 1993

*Attest:*

Bruce Lehman

BRUCE LEHMAN

*Attesting Officer*

*Commissioner of Patents and Trademarks*